US007812719B2

(12) United States Patent
Djuric et al.

(10) Patent No.: US 7,812,719 B2
(45) Date of Patent: Oct. 12, 2010

(54) RFID SYSTEM AND METHOD FOR LOCALIZING AND TRACKING A MOVING OBJECT WITH AN RFID TAG

(76) Inventors: Petar M. Djuric, 20 Huyler Ct., Setauket, NY (US) 11733; Akshay Athalve, G2103A Chapin Apts., Stony Brook, NY (US) 11790

( * ) Notice: Subject to any disclaimer, the term of this patent is extended or adjusted under 35 U.S.C. 154(b) by 258 days.

(21) Appl. No.: 11/799,257

(22) Filed: May 1, 2007

(65) Prior Publication Data

US 2007/0285245 A1 Dec. 13, 2007

Related U.S. Application Data

(60) Provisional application No. 60/796,705, filed on May 1, 2006.

(51) Int. Cl.
*G08B 1/08* (2006.01)

(52) U.S. Cl. ..... 340/539.13; 340/539.1; 340/539.23; 340/10.1; 340/10.4

(58) Field of Classification Search ... 340/572.1–572.9, 340/10.1, 5.49, 539.13, 539.1, 10.4, 825.49, 340/539.21, 539.23; 702/150–154; 342/118, 342/450–465

See application file for complete search history.

(56) References Cited

U.S. PATENT DOCUMENTS

| | | | | |
|---|---|---|---|---|
| 6,380,894 | B1 * | 4/2002 | Boyd et al. | 342/450 |
| 6,512,478 | B1 * | 1/2003 | Chien | 342/357.09 |
| 6,738,628 | B1 * | 5/2004 | McCall et al. | 455/456.1 |
| 6,917,290 | B2 * | 7/2005 | Land | 340/539.1 |
| 7,323,991 | B1 * | 1/2008 | Eckert et al. | 340/572.1 |
| 2004/0082296 | A1 * | 4/2004 | Twitchell, Jr. | 455/41.2 |
| 2004/0108954 | A1 * | 6/2004 | Richley et al. | 342/387 |
| 2004/0169589 | A1 * | 9/2004 | Lea et al. | 340/825.49 |
| 2005/0012613 | A1 * | 1/2005 | Eckstein et al. | 340/539.13 |
| 2005/0145688 | A1 * | 7/2005 | Milenkovic et al. | 235/375 |
| 2006/0092072 | A1 * | 5/2006 | Steiner | 342/46 |
| 2006/0145815 | A1 * | 7/2006 | Lanzieri et al. | 340/10.2 |
| 2007/0103303 | A1 * | 5/2007 | Shoarinejad | 340/572.1 |
| 2007/0139183 | A1 * | 6/2007 | Kates | 340/521 |
| 2007/0268138 | A1 * | 11/2007 | Chung et al. | 340/572.1 |
| 2008/0094176 | A1 * | 4/2008 | Taira | 340/10.1 |

* cited by examiner

*Primary Examiner*—Davetta W Goins
*Assistant Examiner*—Hoi C Lau
(74) *Attorney, Agent, or Firm*—Scully, Scott, Murphy & Presser, P.C.

(57) ABSTRACT

A radio frequency identification (RFID) system and method for tracking and locating an RFID tag is disclosed. The system includes a reader, an identification tag, at least one sensor-tag and a data processing element. The reader is used to initiate a query for an object with an RFID tag. The identification tag is attached to the object. The RFID tag responds to the query. At least one sensor-tag is positioned near the RFID tag. The at least one sensor-tag functions to receive the response of the RFID tag. The sensor-tag determines whether the identification tag is within a predetermined sensor-tag range. Based upon this determination, the at least one sensor-tag communicates a response signal to the reader when the at least one sensor-tag receives a predetermined request signal from the reader. Based on the responses of the sensor-tags, the location of the object with the responding RFID tag can be calculated.

19 Claims, 8 Drawing Sheets

RFID SYSTEM AND METHOD FOR LOCALIZING AND TRACKING A MOVING OBJECT WITH AN RFID TAG

CROSS-REFERENCE TO U.S. PROVISIONAL APPLICATION

This Application claims benefit of U.S. Provisional Application No. 60/796,705 filed May 1, 2006.

FIELD OF THE INVENTION

The invention relates to a location system for radio frequency identification tags. More particularly, the invention relates to a system and method for locating and tracking any motion of an object with an attached RFID tag.

BACKGROUND OF THE INVENTION

Radio-Frequency Identification (RFID) relates to identification of objects by using electromagnetic radiation. RFID systems typically include two types of components, (1) RFID readers and (2) RFID tags.

RFID readers are transmitters of radio signals that are connected to external electric power sources. This power drives their antennas and creates radio waves. The RFID tags are integrated circuits that contain radio-frequency circuitry and information that identifies the tags. This invention is related to RFID systems in which tags communicate with the reader using the principle of backscatter modulation. When the radio waves transmitted by the reader are received by RFID tags, part of the received energy is reflected by the tags in a way that identifies the tag. The reader also acts as a radio receiver, and if it detects the reflected signal from the tag, the reader can identify the tag.

There are three desirable operations related to RFID systems: 1) object detection and identification, 2) accurate localization of the object upon detection and identification, and 3) tracking of the object if it is moving.

Current RFID systems can perform the task of object detection and identification but have difficulty with the remaining two tasks. In radio based communication systems, localization can be done using several established principles such as signals' time-of-arrivals (TOAs), time differences of arrivals (TDOAs), angle of arrivals (AOAs), or received signal strengths (RSSs).

However, implementation of these methods in RFID systems is extremely costly. Such systems require complex readers employing intensive signal processing and need for multiple antenna arrays. Additionally, for a typical RFID system the small distances between the reader and the tags cause difficulty in determining the range of the tag. The presence of multipath in indoor environments where RFID systems are most commonly used also causes errors in the calculation of the range.

Accordingly, there is a need to provide an RFID system that overcomes the aforementioned problems and can accurately locate and track an object with an RFID tag.

SUMMARY OF THE INVENTION

Accordingly, disclosed is an RFID system that can accurately locate and track RFID tags upon identification by the reader.

The disclosed system includes an RFID reader, RFID tags, a plurality of a newly invented element, referred to as a sensor-tag which is also disclosed herein, and a data processing element (for example, a personal computer). The reader is used to initiate a query for tags. The tags are attached to the objects that are to be identified. The RFID tag will respond to the query. A plurality of sensor-tags are pre-positioned in the interrogation zone of the reader. The locations of the sensor-tags are known prior to system operation. The sensor-tag functions to receive the responses from responding RFID tags in its vicinity. Each sensor-tag will determine whether the RFID tag is within a predetermined range around itself. Based upon this determination, the sensor-tag communicates a response to the reader upon receiving a request signal from the reader. The data processing element employs a method for processing the responses received from the RFID tag and the sensor-tags to determine the position of the RFID tag using a predefined calculation. The data processing element can be embedded in said reader or a separate element like a personal computer.

Each sensor-tag can be randomly deployed or positioned based upon a predetermined pattern.

The system is used for locating and tracking an object having the RFID tag.

Also disclosed is a location determination method that comprises initiating a query for tag identification using an RFID reader, responding to the query by a radio frequency identification (RFID) tag, receiving the response signal from the tag by at least one sensor-tag deployed in the interrogation zone of the reader, determining if the radio frequency identification (RFID) tag that responded to the query is within a predetermined range around the at least one sensor-tag, communicating the results of this determination to the reader when the at least one sensor-tag receives a request signal and determining the location of the RFID tag using the responses from the RFID tag and the sensor-tag. The determination step at the sensor-tag further comprises the sub-steps of demodulating and decoding the RFID tag response at the sensor-tag and modifying bits of information in a tag location register on the sensor-tag based upon the detected RFID tag response.

In the preferred embodiment of the invention the disclosed system comprises of RFID readers and RFID tags compliant with the EPC Global Gen 2 standard.

In another embodiment of the invention, the interference occurring at the at least one sensor-tag between the tag response signal and the continuous wave (CW) signal received from a reader during tag backscattering is accounted for by modifying the backscattering of RFID tags such that the amplitude and/or phase of the signal backscattered from the RFID tag is varied in a predetermined controlled manner.

The detection range for each sensor-tag is set based upon a threshold value for a minimum received power of said response signal required for detection of said RFID tag by said each sensor-tag.

The location of each sensor-tag is known before the query for the RFID tags is initiated. Each sensor-tag is assigned a unique identifier. Based upon the responses of the sensor-tags, the location of the identified RFID tag can be accurately determined.

In one embodiment, motion tracking is performed by estimating a change in location of the RFID tag over time by repeatedly querying and calculating the location of the RFID tag from sensor-tag responses. A change in the estimated location indicates movement of the RFID tag.

The sensor-tags can be systematically deployed along a predetermined grid or may be randomly positioned. In case they are randomly positioned, the method for determining the positions of the sensor-tags includes the steps of transmitting a request signal from a reader at different power levels, sending a reply signal from the each of said at least one sensor-tags including each sensor-tag's identification if the request signal from the reader is received. Estimating each sensor-tag's position based upon whether the reply signal from sensor-tag is received, relocating the reader to a known position within a predefined area and repeating these sub-steps until all of the at least one sensor-tag's positions are estimated.

BRIEF DESCRIPTION OF THE DRAWINGS

These and other features, benefits, and advantages of the present invention will become apparent by reference to the following text and figures, with like features having consistent labels.

DETAILED DESCRIPTION OF THE INVENTION

Figure 1:
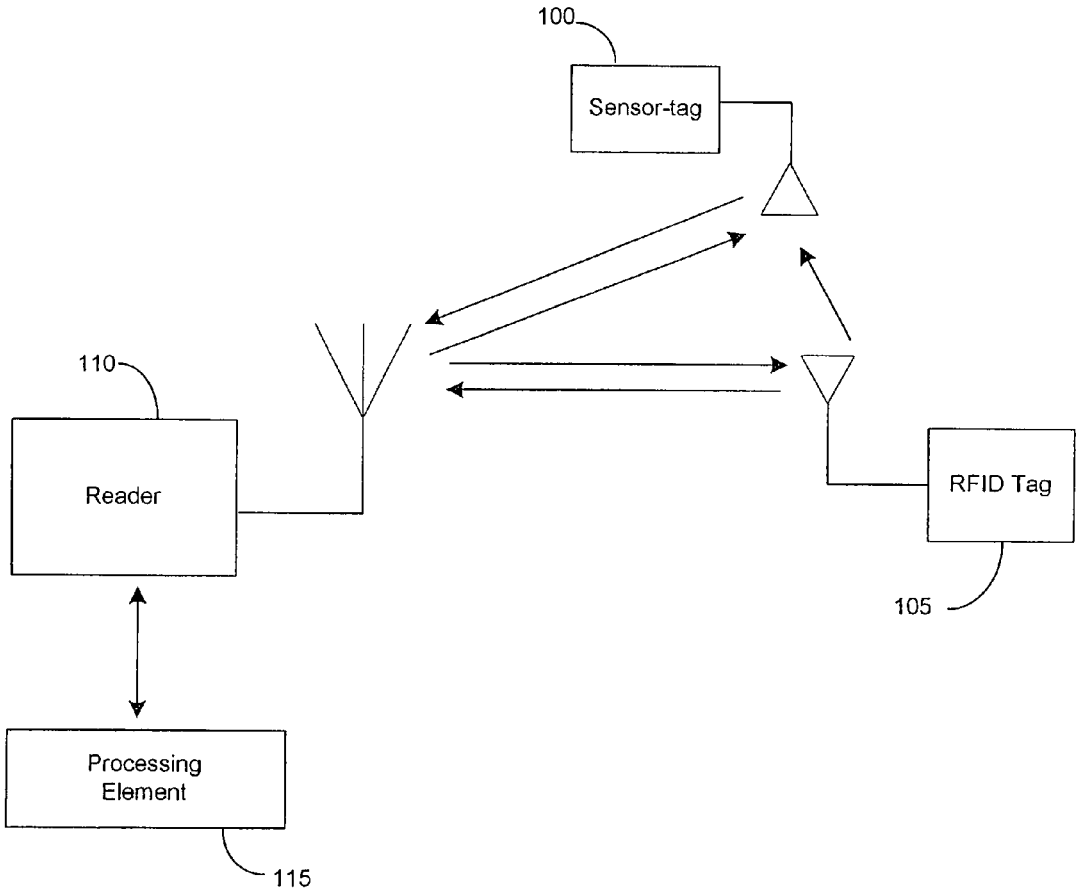
FIG. 1 illustrates the RFID system according to a first embodiment of the invention.

FIG. 1 illustrates a radio-frequency identification (RFID) system 1 according to the first embodiment of the invention. The RFID system 1 includes at least one sensor-tag 100, at least one object identification RFID tag 105, an RFID reader 110 and a data processing element 115.

The RFID tag 105 communicates with the reader 110 by backscatter modulation. A certain fraction of power incident on the tag antenna is reflected back to the reader 110. The reflected power is therefore, proportional to the power received by the RFID tag 105.

The sensor-tag 100 also communicates with the reader 110 using backscatter modulation. The sensor-tag 100 provides additional information to the readers 110 so that RFID tags 105 can be located or tracked easily and accurately. The number of sensor-tags 100 in the RFID system 1 is a design parameter and would depend upon desired accuracy in the localization and tracking. The more sensor-tags 100 the RFID system 1 has, the higher the accuracy of its localization and tracking would be. Each sensor-tag 100 is assigned a unique identifier.

The sensor-tags 100 are positioned within a given area and their locations are known to the system prior to operation. The deployed sensor-tags 100 are designed to sense and respond to queries from the reader 110 according to a predetermined protocol. In addition the sensor-tags are designed to sense and decode the response from RFID tags in a predetermined range around them also according to a predetermined protocol.

Figure 2:
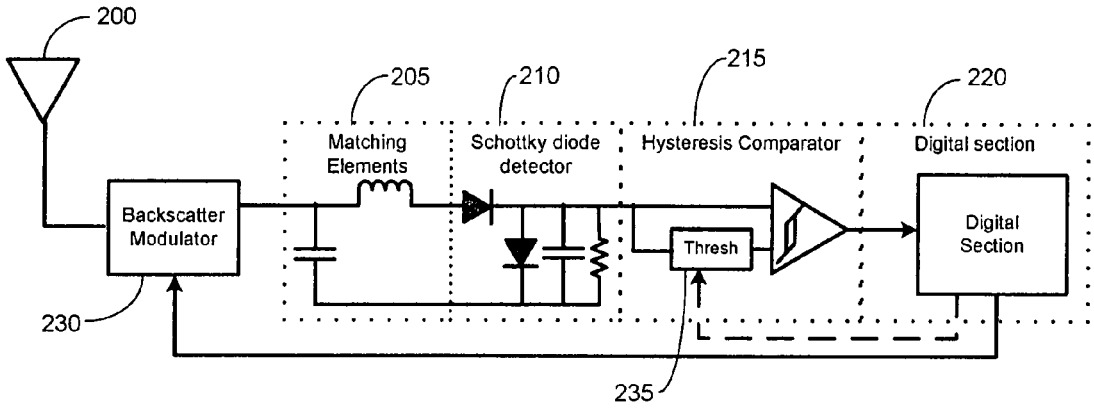
FIG. 2 illustrates a circuit diagram of a sensor-tag according to the invention.

As shown in FIG. 2, the sensor-tag consists of an antenna 200 with relevant matching elements 205. The matching elements are followed by a Schottky diode based detector circuit 210. In one embodiment of the invention, a voltage doubler configuration is used to optimize the performance at low power levels. The output of this circuit is an envelope of the received signal. A hysteresis comparator 215 digitizes the detected envelope. The output is provided as binary data to the digital platform 220 of the sensor-tag, which implements the desired functionality of the sensor-tag. The sensing range depends upon the reference level of the hysteresis comparator 215. The reference level of the comparator is set by the threshold generation circuit 235. In one embodiment of the invention, the reference level of the hysteresis comparator is varied for detection of reader signals and tag response, respectively. This can be done by controlling the threshold generation circuit 235 by a signal from the digital section 220 of the sensor-tag. The backscattered signal of the RFID tag 105 is in Amplitude Shift Keyed (ASK) or Phase Shift Keyed (PSK) format. This response is received and digitized by the sensor-tag. By varying the reference level of the comparator, the area around the sensor-tag where a responding RFID tag will be sensed, i.e. the sensing range, can be varied.

The digital platform is an application specific integrated circuit (ASIC) implementing the protocol for communicating with the reader 110 and recognizing the reply by an RFID tag 105. In the basic embodiment, the sensor-tag protocol is designed such that it is compatible with RFID readers and RFID tags compliant with the EPC Global Gen 2 standard.

The sensor-tag conveys information of presence or absence of a responding RFID tag in its vicinity to the reader by backscatter modulation similar to that of an RFID tag. The backscatter modulator 230 modulates the information onto the carrier transmitted by the reader 110. The modulator 230 includes a switch, which can be implemented using transistors or diodes. The switch toggles the impedance of the sensor-tag's antenna 200 between two states in accordance with the information to be conveyed to the reader 110.

In one embodiment, the sensor-tag 100 is a passive device. In other words, the power supply needed for the analog and digital circuitry in this device is derived from the radiation sent by the reader. When the sensor-tag 100 is a passive device, the Schottky diode voltage doubler circuit and 210 act as a rectifier for the input power from the reader. Further, an additional voltage regulator (not shown) will be required to obtain a DC voltage from this rectified signal.

In another embodiment, the power supply is generated by a small on-board battery (not shown). The sensor-tag 100 still communicates with the reader 110 via backscattering, thus making it a semi-passive device.

According to the invention, the RFID system comprises of three components viz. RFID reader, RFID tags and a plurality of sensor-tags. There is a two way communication between the reader 110 and RFID tag 105, a two way communication between reader 110 and sensor-tag 100, and a one way communication from RFID tag 105 to sensor-tag 100.

Figure 3:
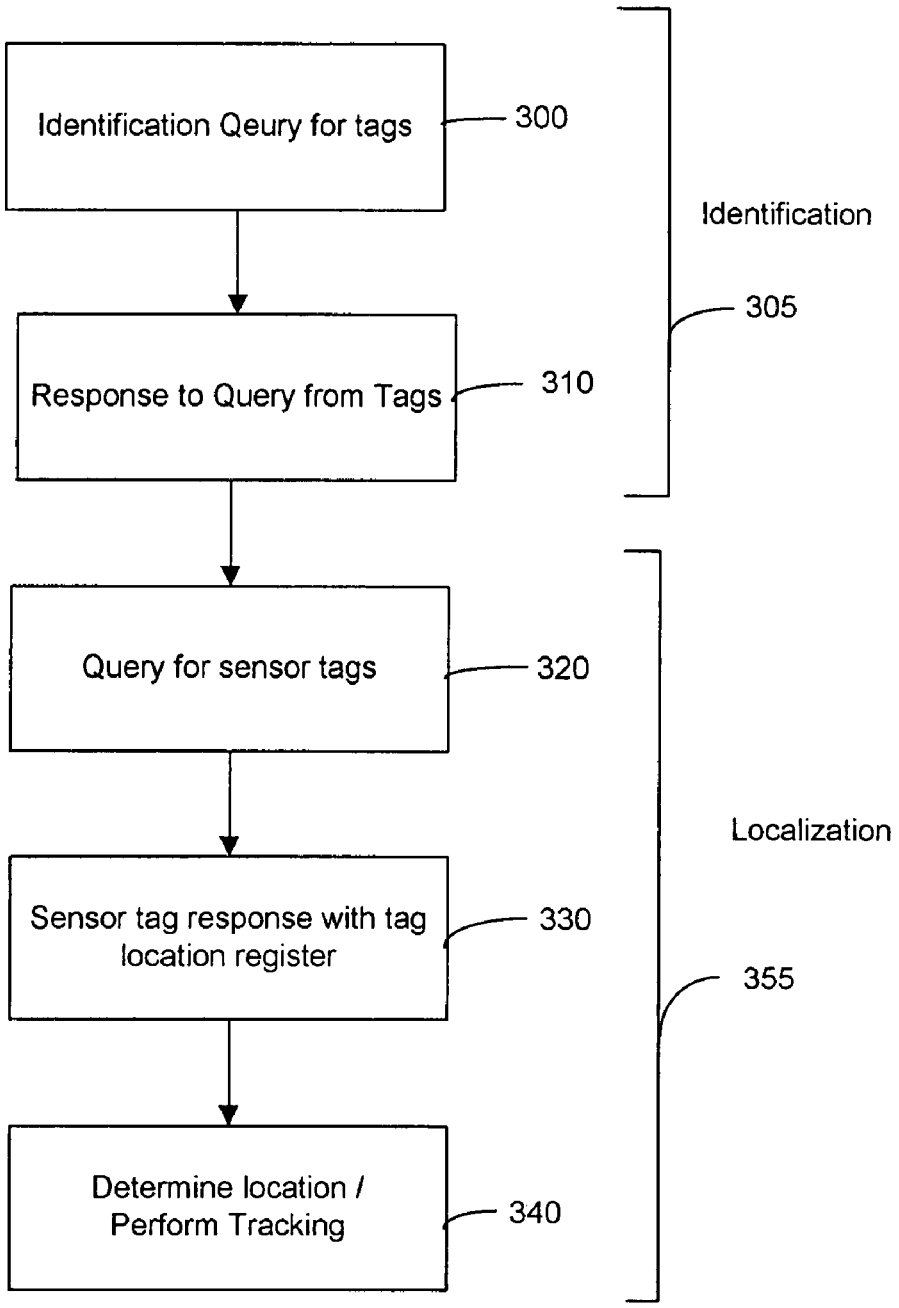
FIG. 3 illustrates a flow chart for the method of localizing or tracking a RFID tag in accordance with the first embodiment of the invention.

FIG. 3 illustrates a flow chart for the method used for locating the identified RFID tag according to the invention. The method is performed in two stages; the first stage 305 is identification of a particular RFID tag. This stage includes two steps 300 and 310. At step 300 the reader initiates an identification query. The queried tags will respond to the identification query at step 310. The tag responses will be detected by the sensor-tags deployed in the respective vicinity of the responding RFID tags. The sensor-tags which detect the presence of responding tags will store this information in the form of binary bits in a tag location register.

The localization stage 355 is initiated by the reader 110 by transmitting a query for the sensor-tags. Upon receiving this query, the sensor-tags respond with their IDs and the information in the tag location register which indicates whether or not they detected a responding tag in the previous (identification) stage. The IDs of the sensor-tags correspond to known locations of the sensor-tags.

In one embodiment, the reader 110 will relay the responses from the sensor-tags 100 to the remote data processing element 115. The remote processor 115 will calculate a location and/or track the motion of the RFID tag 105 using one of the methods that will be described later.

Alternatively, in another embodiment, the location determination and tracking is done by the reader 110 itself.

Figure 4:
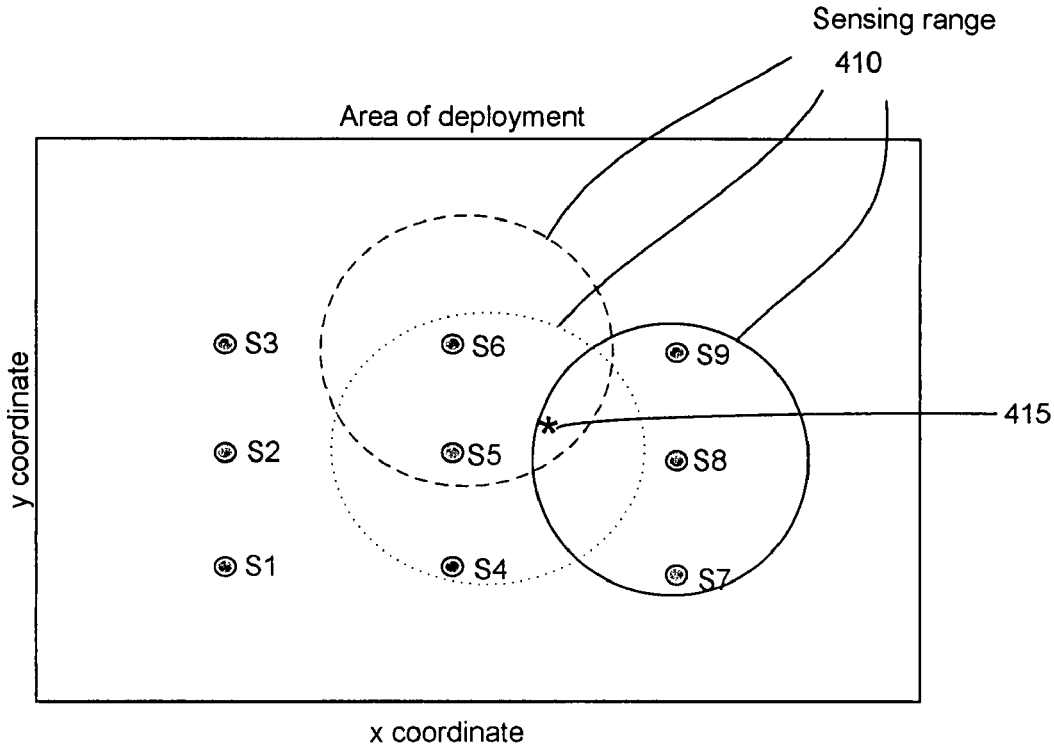
FIG. 4 illustrates an example of a sensor-tag deployment created from nine sensor-tags having a RFID tag within a sensing range of at least one sensor-tag.

FIG. 4 is an example of the deployment of nine sensor-tags, (S1-S9) generically referenced as sensor-tag 100 or sensor-tags S1-S9 used for localization of an RFID tag 105. Each of the sensor-tags S1-S9 has a predefined sensing range 410. A parameter that defines the sensing range 410 is the threshold or reference level of the hysteresis comparator that is used for detecting the backscatter from the RFID tag 105. The lower the threshold, the larger the sensing range 410 will be.

The predefined sensing range 410 can be adjusted to increase or decrease the distance in which a sensor-tag can detect a backscattering RFID tag 105. The predefined sensing range 410 is depicted as a circle in FIG. 4; however, the sensing range can have different shapes. The position of the RFID tag is displayed with a star 415.

According to the invention, the sensor-tags in the vicinity of the backscattering RFID tag 105 sense its response and modify the contents of their respective tag location register. This information is conveyed to the reader 110 upon receiving a request. The reader 110 is not depicted in FIG. 4.

Figure 5:
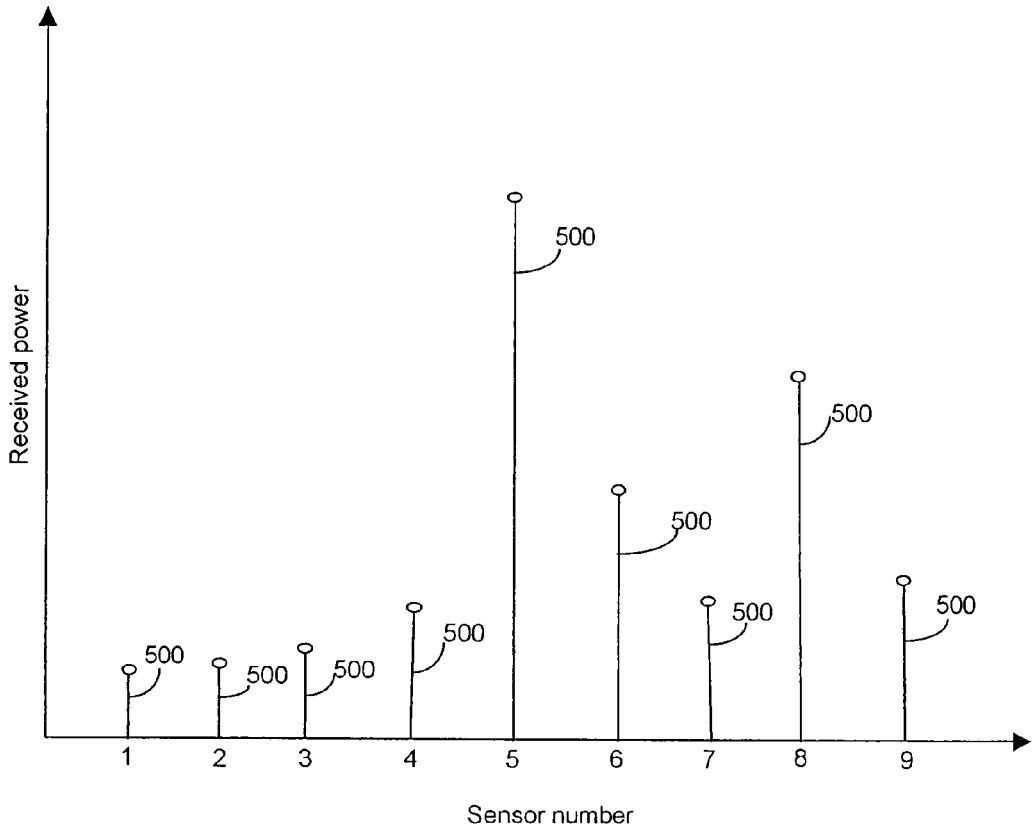
FIG. 5 illustrates power received by the nine sensor-tags depicted in FIG. 4 from the responding RFID tag in accordance with the first embodiment of the invention.

FIG. 5 illustrates the received powers 500 by the various sensor-tags S1-S9 from FIG. 4. As can be seen from FIG. 5, the higher the received power 500, the closer to the sensor-tag 100 the RFID tag 105 is. In FIG. 5, sensor-tags (S5, S6 and S8), as shown have the RFID tag 105 within its predefined sensing range 410.

The largest power is received by sensor-tag S5 because its location is the closest to the RFID tag 105 and the next two are the sensor-tags S6 and S8. Based upon the received power 500, only sensor-tags S5, S6, and S8 will detect the RFID tag 105, i.e., the power of the RFID tag response received at these sensor-tags will be greater than their predefined threshold.

In one embodiment, the location of the tag can be estimated based on the known locations of the sensor-tags that detected the RFID tag using the principle of trilateration. Specifically, the intersection of the sensing ranges for the sensor-tags 100 that detected the RFID tag will be used to determine the location of that RFID tag 105. The more sensor-tags 100 deployed in a given area, the greater is the accuracy of the location estimate.

In the preferred embodiment, the ranges of the sensor-tags 100 deployed within a given area are appropriately assigned such that the RFID tag 105 can be located with increased precision.

In one embodiment the location of the RFID tag 105 is estimated using the following method. The sensor-tags 100 are deployed at known locations denoted by $y_m=(y_{1,m}\ y_{2,m}\ y_{3,m})^T$, where m denotes the index of the sensor-tag 100. When a queried RFID tag 105, which is indexed by n and whose location is $x_n=(x_{1,n}\ x_{2,n}\ x_{3,n})^T$, backscatters a response, a nearby sensor-tag 100 receives a signal which is modeled as $$z_{nm} \sim N(v_m(x_n), \sigma_y^2)$$

where N(*,*) denotes a Gaussian distribution and $$v_m(x_n) = \Psi_n + 10\alpha_{nm}\log_{10}\frac{d_0}{|y_n - x_n|}$$

with $v_m(x_n)$ being the received power in dBm at the sensor-tag 100 from the nth RFID tag 105, $\alpha_{nm}$ is a known path loss coefficient between the sensor-tag 100 at $y_m$ and the backscattering RFID tag 105 at $x_n$, $\Psi_n$ is the measured power in dBm from the RFID tag 105 at a distance $d_0$, $|y_m-x_n|$ is the distance between the RFID tag 105 and the sensor-tag given by $$|y_m-x_n|=\sqrt{(y_{1,m}-x_{1,n})^2+(y_{2,m}-x_{2,n})^2+(y_{3,m}-x_{3,n})^2}$$

and $\sigma_y^2$ is the variance of the shadowing. If the received power 500 by the sensor-tag 100 at $y_m$ is greater than its threshold, the sensor-tag 100 will detect the presence of the tag and convey this information to the reader 110.

The calculation of the location of the RFID tag 105 is based on the received responses from the sensor-tags $r_1, r_2, \ldots, r_M$. These responses can be considered as binary measurements, i.e., $r_m$, m=1,2, . . . ,M, is '1' if sensor-tag 100 indexed by 'm' sensed the RFID tag in its vicinity, and '0' otherwise.

The location of the RFID tag 105 has a posteriori density give by $$p(x|r) \propto p(r|x)p(x)$$

where $x=(r_1\ r_2 \ldots r_M)^T$, p(r|x) is the likelihood and p(x) is the prior of x. Any prior knowledge about the location of the tag is modeled by p(x). A maximum a posteriori solution is used for the location of the RFID tag 105. The maximum a posteriori solution is given by $$\hat{x} = \arg\max_x \{p(r \mid x)p(x)\}$$

The likelihood is given by $$p(r \mid x) = \prod_{m=1}^{M} p(r_m \mid x)$$

where $p(r_m|x)$ equals $$p(r_m|x)=\int_\gamma^\infty p(r_m|z_m)p(z_m|x)dz_m$$

and where $z_m$ is the received backscattered signal from the RFID tag 105 by the m-th sensor-tag and γ is the threshold of the sensor-tag 100. Therefore, the estimate of the location of the RFID tag 105 is given by $$\hat{x} = \arg\max_x \left\{ p(x) \prod_{m-1}^{M} \int_\gamma^\infty p(r_m \mid z_m) p(z_m \mid x) dz_m \right\}$$

Figure 6:
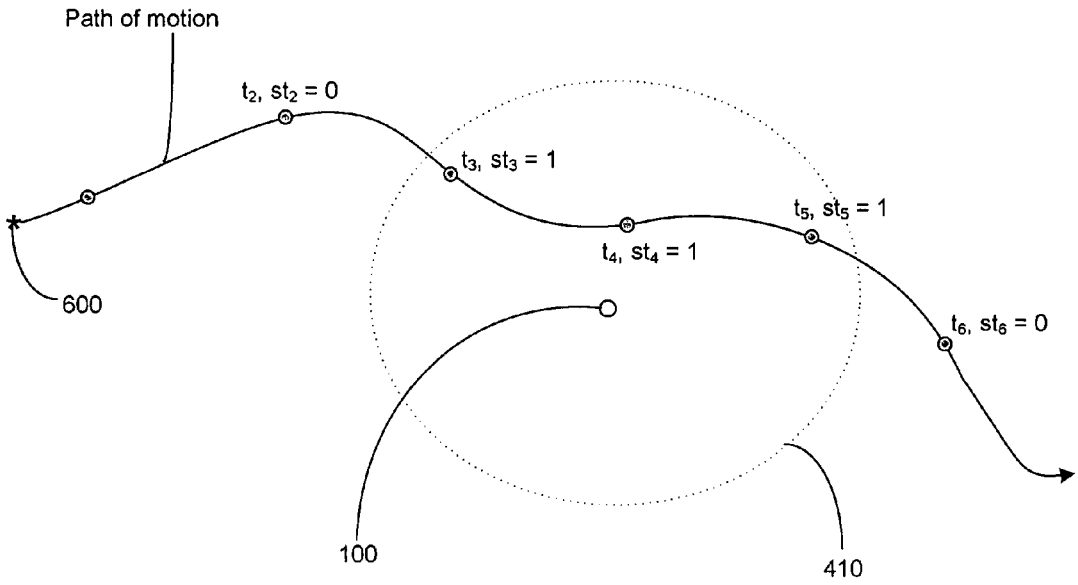
FIG. 6 illustrates an example of tracking the motion of a RFID tag using a sensor-tag in accordance with the first embodiment of the invention.

In another embodiment, the RFID system 1 can be also used to track the position of a moving object with an RFID tag 105. FIG. 6 depicts a moving tag 600 in the vicinity of a sensor-tag 100. The sensor-tag 100 is represented by a small circle and its predefined sensing range 410 by a large circle. The trajectory of the moving tag 600 is represented by the solid line, and the dots on the line show the positions of the tag at various time instants. The tracking process is initiated by the reader. A reader 100 queries the moving tag 600 and the moving tag 600 responds via a backscatter signal.

If the moving tag 600 that backscatters the signal is outside the predetermined sensing range 410 of the sensor-tag 100, the received signal by the sensor-tag 100 is below the set threshold, and the sensor-tag 100 does not detect the tag 600, e.g., at time instants t1, t2 and t6. During the time when the tag 600 is inside the predefined sensing range 410 of the sensor-tag 100, the received signal is above the threshold, and it detects the moving tag 600, e.g., at instants t3, t4, and t5, and conveys this information to the reader 110 upon receipt of a request from the reader 110.

The set of sensor-tag responses are used to estimate the trajectory of the moving object with the RFID tag.

FIG. 6 only depicts one sensor-tag 100 within the given area, however, in practice a plurality of sensors-tags 100 will be deployed within a given area.

The motion of the moving object with the RFID tag can be modeled using one of several possible sets of mathematical equations. These models reflect the layout of the interrogation area and the sensor-tag deployment. The motion of the tag can be then tracked using one or more of several known methods. Two known methods include Kalman filtering and particle filtering. Kalman filtering is described in the textbook entitled Optimal Filtering, authored by B. D. O. Anderson and J. B. Moore, published in 1979. This textbook is incorporated by reference herein. Additionally, particle filtering is described in the textbook entitled Sequential Monte Carlo Methods in Practice edited by A. Doucet, J. de Freitas, and N. Gordon published in 2001. This textbook is incorporated by reference herein.

As previously mentioned in this document, the location of each sensor-tag 100 is fixed and known. In one embodiment of the invention, each sensor-tag 100 is positioned on a predefined grid, where the coordinates of the grid are known.

Alternatively, in another embodiment, the sensor-tags 100 are randomly positioned in a given area. In situations where the deployment is random there is a need to obtain the exact position for each sensor-tag prior to using the system for locating RFID tags. This is carried out during the installation of the system.

Figure 7:
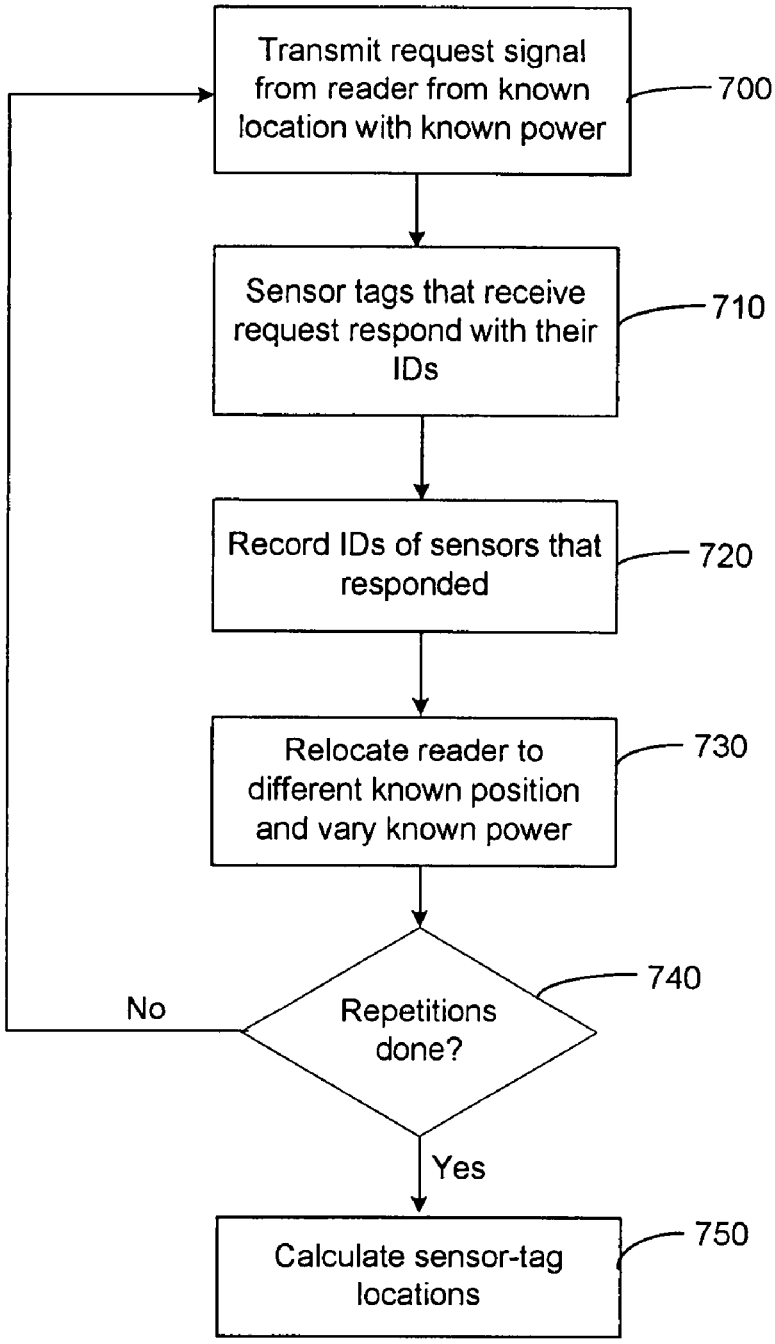
FIG. 7 illustrates a flow chart for the method of determining a location for each of the sensor-tags during sensor-tag deployment according to an embodiment of the invention.

FIG. 7 illustrates a flow chart for determining the position for each sensor-tag 100 during random deployment. The process is initiated by reader 110 by transmitting a request signal for sensor-tag IDs from known location and known power at step 700. If the sensor-tags 100 receive the transmitted request, they respond with their ID, step 710. In general, when the reader is within a predefined range around the sensor-tag, the sensor-tag receives the request signal from the reader and responds. Otherwise, the sensor-tag is in a standby mode. At step 720, the IDs of the sensor-tags that responded are recorded. In the next step, 730, the reader is relocated to another known location and the process repeated with different known power levels. The received IDs of the sensor-tags along with the known positions of the reader and the power levels of the transmitted request signal are sent to the processing element 115.

This process is repeated (step 740) until all the predefined known reader locations are passed and power levels are used.

Based on the received information from the reader 110, the processing element 115 computes the locations of the sensor-tags, at step 750. A database of locations for all of the sensor-tags is maintained by the system.

Additionally, prior to operation, the sensing range for each sensor-tag must be defined. The sensing range 410 is defined by a threshold that establishes the minimum value of the backscatter power required for RFID tag detection. However, the threshold must account for the total power received by each sensor-tag 100. The total power received by the sensor-tag 100 will include power from the reader 110 and the RFID tag 105. This is because the reader 110 is continuously transmitting continuous wave (CW) signal during tag backscattering.

Accordingly, the total power received at the sensor-tag 100 depends on the distance between the sensor-tag 100 and the RFID tag 105 denoted by $\rho_{RT}$, the distance between the sensor-tag 100 and the reader 110 denoted by $\rho_{RS}$, and the distance between the reader 110 and the RFID tag 105 denoted by $\rho_{TS}$. Additionally, the total power depends on the total power transmitted by the reader (controlled by FCC regulations), the gains of the reader, tag and sensor-tag antennas, and the characteristics of the environment.

The power received at the RFID tag 105 from the reader 110 equals:

$$P_T = \frac{P_R G_R G_T \lambda^2}{4\pi \rho_{RT}^2}$$

where $P_R$ is the transmitted power of the reader 110, $G_R$ and $G_T$ are the gains of the reader 110 and RFID tag 105, and $\lambda$ is the wavelength of the RF signal.

The amount of backscattered power depends upon the reflection cross section (RCS) $\sigma$. The power received at the sensor-tag 100 from the RFID tag 105 which is the power available for detection equals $$P_T = \frac{\sigma P_R G_R G_T^2 G_S \lambda^4}{4\pi \rho_{RT}^2 \rho_{TS}^2}$$

where $G_S$ is the gain of the antenna of sensor-tag 100.

The predefined sensing range 410 for each sensor-tag 100 and the corresponding threshold value must be set to account for $P_S$, $P_T$, and the distances. By varying the threshold value, the shape of the predefined sensing range 410 is adjusted.

In a preferred embodiment, the threshold of each sensor-tag 100 is predefined such that a uniform sensing range is established for all the sensor-tags. Additionally, the threshold will be selected based upon the number of sensors-tags 100 used and the accuracy needed for the particular implementation for the RFID system 1. An increase in the threshold value decreases the sensing range 410. For a given constellation, one can find the set of thresholds that allow for the most accurate estimation of the location. The thresholds can be obtained by an optimization method that maximizes the accuracy of the location process for that constellation.

Detection of RFID tag 105 will occur for a given threshold $\gamma$ if the following conditions are satisfied:

$$\frac{\sigma P_R G_R G_T^2 G_S \lambda^4}{(4\pi)^2 \rho_{RT}^2 \rho_{TS}^2} \geq \gamma$$

or

-continued $$\frac{1}{\rho_{RT}^2\rho_{TS}^2} \geq \gamma'$$

or $$\rho_{RT}\rho_{TS} \leq \gamma''$$

In another embodiment, the sensing region of the sensor-tag is varied by varying the power transmitted by the reader $P_R$.

Efficient detection also depends upon accounting for any interference between the backscattered signal from the RFID tag 105 and any other signal received at sensor-tag 100. There is a potential for signal interference at the sensor-tag 100 due to simultaneous reception of the backscatter from the RFID tag 105 and the continuous wave (CW) signal transmitted from the reader 110. For particular locations or constellations, the sensor-tag 100 might not be able to detect the backscattered signal of the RFID tag 105 even though the RFID tag 105 is well within its sensing range.

This is caused by destructive interference between the backscatter from the RFID tag 105 and the CW signal from the reader 110 received at the sensor-tag 100 during tag backscattering. The envelope detector detects level changes in the envelope of the backscattered signal at the two states of the tag's backscatter modulation switch. When relative phases cause the envelope levels to be the same in both states, the sensor-tag is not able to detect the backscatter from the tag even though the tag is present in its vicinity.

The backscatter from the tag is generated by toggling a switch which alternates its antenna's impedance between two states, i.e., 1 and 2. Mathematically, the total signal received at the sensor-tag when the modulation switch is in state 1 can be represented as $$\begin{aligned} z_1(t) &= A_R\cos(2\pi f_r t) + A_{T1}\cos(2\pi f_r t - \theta) + w(t) \\ &= A_R\cos(2\pi f_r t) + A_{T1}\cos(2\pi f_r t)\cos\theta + A_{T1}\sin(2\pi f_r t)\sin\theta + w(t) \\ &= (A_R + A_{T1}\cos\theta)\cos(2\pi f_r t) + A_{T1}\sin(2\pi f_r t)\sin\theta + w(t) \end{aligned}$$

where $z_1(t)$ is the total signal received at the sensor-tag in state 1, $A_R$ is the amplitude of the reader signal, $A_{T1}$ is the amplitude of the tag backscatter in state 1, $f_r$ is the reader frequency, $\theta$ is the relative phase shift of the tag signal w.r.t the reader signal at the sensor-tag and w(t) represents the noise. Similarly, the received signal at the sensor-tag when the modulation switch is in state 2, can be represented as $$z_2(t)=(A_R+A_{T2}\cos\theta)\cos(2\pi f_r t)+A_{T2}\sin(2\pi f_r t)\sin\theta+w(t)$$

where $z_2(t)$ is the total received signal at the sensor-tag when the tag modulation switch is in state 2, and $A_{T2}$ is the amplitude of the tag backscatter in this state.

For clarity, we neglect the noise and write $$z_1(t) = B_1\cos(2\pi f_r t + \phi_1)$$

$$z_2(t) = B_2\cos(2\pi f_r t + \phi_2)$$

where

-continued $$\begin{aligned} B_1 &= \sqrt{(A_R + A_{T1}\cos\theta)^2 + A_{T1}^2\sin^2\theta} \\ &= \sqrt{A_R^2 + 2A_R A_{T1}\cos\theta + A_{T1}^2} \end{aligned}$$

$$\begin{aligned} B_2 &= \sqrt{(A_R + 2A_{T2}\cos\theta)^2 + A_{T2}^2\sin^2\theta} \\ &= \sqrt{A_R^2 + 2A_R A_{T2}\cos\theta + A_{T2}^2} \end{aligned}$$

and $$\phi_1 = \tan^{-1}\left(\frac{A_{T1}\sin\theta}{A_R + A_{T1}\cos\theta}\right)$$

$$\phi_2 = \tan^{-1}\left(\frac{A_{T2}\sin\theta}{A_R + A_{T2}\cos\theta}\right)$$

The envelope level of the received signal in the two states will be the same when $$B_1=B_2$$

or when $$\theta = \cos^{-1}\left(\frac{A_{T2}^2 - A_{T1}^2}{2A_R(A_{T1} - A_{T2})}\right)$$

When the above equation is satisfied, the envelope detector will be unable to detect the tag's backscatter although it is present in its vicinity. Note that $\theta$ is constant for a given constellation of sensor-tag, tag and reader. In other words, if $A_{T1}$, $A_{T2}$ and $A_R$ satisfy the last expression, the backscatter from the tag will be effectively cancelled.

In one embodiment of the invention, this destructive interference is avoided by controlling the phase and/or the amplitude of the backscattered signal from the RFID tag 105.

The backscattered signal received by a sensor-tag 100 is given by $$y_T(t)=A_T(t)\cos(2\pi f_r t+\theta-\psi)$$

where $\psi$ is a controllable phase introduced by the RFID tag 105. Note that $\theta$ cannot be controlled. The envelope detector in the presence of backscattered signal from RFID tag 105 produces envelope given by $$B(t)=\sqrt{(A_R{}^2+2A_R A_T(t)\cos(\theta-\psi)+A_T(t)^2}$$

The envelope is a function of the phase $\alpha=\theta-\psi$. In order to avoid this situation where the sensor-tag is "blind" to tags in its range, the RFID tag 105 must backscatter the response with at least two initial phases, $\psi$, e.g., $\psi_0=0$ and $\psi_1=\pi/2$. One can select any number of different phases for the controlled phase, i.e., $\psi_k$ where k=0,1,2, . . . ,K−1. However, the choice of $\psi_k$ and K depend upon the implementation of the RFID system and the environmental conditions.

To enable the RFID tag to backscatter at different phases as needed to avoid destructive interference, the existing RFID tag 105 must be modified.

Figure 8:
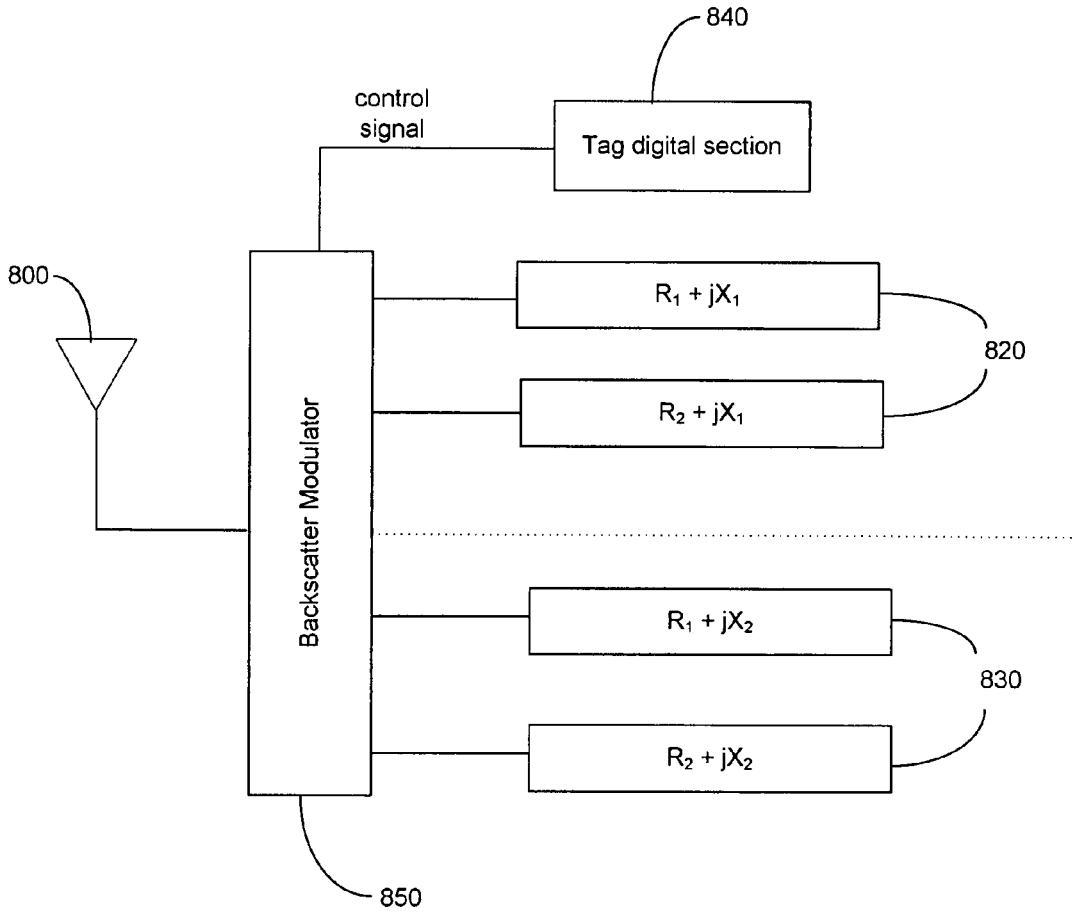
FIG. 8 illustrates a block diagram of the RFID tag performing backscattering at different phases according to an embodiment of the invention.

FIG. 8 illustrates a block diagram of the modified portion of the RFID tag that allows for generating different phases to avoid destructive interference The modified tag will be referenced as RFID tag 800. Like elements of the tag will be references with the same reference numbers. The amplitude and phase of the backscattered power from the tag 800 is determined by its complex reflection cross section (RCS), which depends upon the complex impedance terminating the tag antenna 810. The absolute value of this terminating impedance determines the amplitude of the backscattered power. The phase of the backscatter can be varied by varying the imaginary component of the impedance (capacitance or inductance) (not shown) connected to the antenna 810. To backscatter an ASK modulated signal at two different phases (820 and 830, in FIG. 8), the tag 800 will include a tag modulator 1110 as shown in the FIG. 8. The tag modulator 850 will use two separate ASK modulators with terminating impedances having imaginary components to control the phase of the backscatter. Each ASK modulator consists of a switch toggling between two complex impedances. The imaginary part of these impedances determines the phase of the ASK modulated backscatter. FIG. 8 shows the construction of the modulator for backscattering at two phases, 820 and 830. However, any number of ASK modulators can be used, where the number of ASK modulators will increase with the number of different phases that the tag 800 can backscatter. The tag 800 further includes a tag digital platform 840.

The number of phases that the tag 800 can backscatter at will be determined by the implementation of the tag 800. However, the more phases that the tag 800 can backscatter with, the higher the complexity of the tag 800 is, i.e., it has more components. The higher this number, the greater is the chance of nullifying the mentioned destructive interference and the higher is the tag complexity and cost.

What is claimed is:

1. A radio frequency identification (RFID) system for object location and tracking comprising:

an RFID reader for initiating a query for an RFID tag attached to an object;

an RFID tag attached to said object for responding with a first response signal to said query, said query being received directly from said RFID reader;

at least one sensor-tag for passively receiving a combined signal including said first response signal from said RFID tag and said query from said RFID reader, receipt, by said at least one sensor-tag, of said first response signal and said query is substantially simultaneous, passively demodulating said combined signal and decoding the first response signal from said RFID tag, and determining if said RFID tag is in a predetermined range of said at least one sensor-tag based on said passive demodulation and decoding;

the said at least one sensor-tag passively communicating a second response signal by using backscatter modulation to said RFID reader, based upon the determination, when said at least one sensor-tag receives a request signal from said RFID reader; and a data processing element for processing said second response signal received from said at least one sensor-tag to determine the location of said RFID tag using a predefined calculation, a known position of said at least one sensor-tag and said predetermined range of said at least one sensor-tag.

2. A location determination method comprising:

(a) initiating a query for identification using a radio frequency identification (RFID) reader;

(b) responding with a first response signal to said query by a radio frequency identification (RFID) tag, said query is received directly from said RFID reader;

(c) receiving passively said first response signal at least one sensor-tag;

(d) receiving passively said query at said at least one sensor-tag from said RFID reader, receipt, by said at least one sensor-tag, of said query and said first response signal is substantially simultaneous;

(e) determining if said radio frequency identification (RFID) tag that responded to the query is within a predetermined range of said at least one sensor-tag by passively demodulating a combined signal including said query received from said RFID reader and first response signal from said RFID tag and decoding the first response signal from said RFID tag;

(f) communicating passively a second response signal by using backscatter modulation based upon said determination when said at least one sensor-tag receives a request signal; and (g) determining the location of said RFID tag based upon said second response signal from said at least one sensor-tag using a predetermined method using the predetermined range of said at least one sensor-tag and a known position of said at least one sensor-tag.

3. The location determination method of claim 2, further comprising the step of:

accounting for any interference at said at least one sensor-tag between said first response signal and the query received from a RFID reader by variably controlling amplitude and/or phase of said first response signal from said RFID tag.

4. The location determination method of claim 2, further comprising the step of:

initializing the predetermined range of said at least one sensor-tag for each of said at least one sensor-tag by setting a threshold value for a minimum power value for said first response signal required for detection by said each of said at least one sensor-tags.

5. The location determination method of claim 4, wherein said predetermined range is determined based upon a number of said at least one sensor-tags within an area.

6. The location determination method of claim 2, further comprising the step of:

deploying said at least one sensor-tag in a known location to create a predefined sensor-tag grid.

7. The location determination method of claim 2, wherein step (g) includes determining a location of said RFID tag and tracking movement of said RFID tag.

8. The location determination method of claim 4, wherein the predetermined range is determined based upon signal strength of said query from said RFID reader.

9. The radio frequency identification system of claim 1, wherein said data processing element is a fusion element remotely located from said RFID reader.

10. The radio frequency identification system of claim 1, wherein said data processing element is embedded in said RFID reader.

11. The radio frequency identification system of claim 1, wherein said RFID tag, and at least one sensor-tag are passive elements powered by the radiation received by the said RFID reader.

12. The radio frequency identification system of claim 1, wherein said at least one sensor-tag and/or said RFID tag are semi-passive.

13. The location determination method of claim 2, wherein step (e) includes the sub-steps of:

(a) decoding the said first response signal from said RFID tag to determine if said tag is within said predetermined range of said at least one sensor-tag; and (b) modifying the contents of a tag location register on said at least one sensor-tag based on said determination and passively conveying the contents of the tag location register to said RFID reader along with a predefined response.

14. The location determination method of claim 13, wherein said predefined response includes sensor-tag identification number.

15. The location determination method of claim 2, wherein determining a location of said RFID tag includes estimating the position of said RFID tag by calculating an overlapping area determined by an intersection of all of the predetermined ranges of said at least one sensor-tag that passively communicated said second response signal, said overlapping area contains the location of said RFID tag.

16. The location determination method of claim 7, wherein tracking movement of said RFID tag includes estimating a change in a position of said RFID tag over time by repeatedly calculating an overlapping area determined by an intersection of all of the predetermined ranges of said at least one sensor-tag that passively communicated said second response signal, a change in the overlapping area, over time is the movement of said RFID tag.

17. The location determination method of claim 2, further comprising the steps of: deploying said at least one sensor-tag in a random location, and determining a known position for each of said at least one sensor-tags that are randomly deployed, said determining including the sub-steps of:

(a) transmitting a request signal from a RFID reader at a known location and with known power;

(b) communicating passively a reply signal from each of said at least one sensor-tags including each sensor-tag's identification, if said sensor-tag receives said request signal;

(c) relocating said RFID reader within a predefined area and varying the said known power;

(d) repeating sub-steps (a)-(c) until all of said at known locations are passed and known powers are used;

(e) estimating each sensor-tag's position based upon said received sensor-tag IDs, said known locations of said RFID reader, and said known powers, said estimated position of each sensor-tag is assigned to the corresponding sensor-tag as the known position of the sensor-tag.

18. The location determination method of claim 2, further comprising the step of determining the location of said RFID tag based upon said second response signal from said at least one sensor-tag and said first response signal from said RFID tag using a predetermined method, a known position of said at least one sensor-tag and said predetermined range of said at least one sensor-tag.

19. The radio frequency identification system of claim 1, wherein said data processing element processes said second response signal received from said at least one sensor-tag and said first response signal from said RFID tag to determine the location of said RFID tag using a predefined calculation, a known position of said at least one sensor-tag and said predetermined range of said at least one sensor-tag.

* * * * *